US006463230B1

(12) United States Patent
Wargo

(10) Patent No.: US 6,463,230 B1
(45) Date of Patent: Oct. 8, 2002

(54) OFFICE MACHINE INCLUDING A BLOWER HAVING A BLOWER NOISE REDUCING DEVICE

(75) Inventor: John A. Wargo, Farmington, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/933,213

(22) Filed: Aug. 20, 2001

(51) Int. Cl.[7] ..... G03G 21/20; F04D 29/66
(52) U.S. Cl. ..... 399/92; 415/119
(58) Field of Search ..... 399/92, 93; 415/119, 415/208.1; 96/384

(56) References Cited

U.S. PATENT DOCUMENTS 4,530,589 A * 7/1985 Adams ..... 399/92
5,484,259 A * 1/1996 Ahmed et al. ..... 415/119
5,813,831 A * 9/1998 Matsunaga et al. .. 415/208.1 X
6,039,532 A * 3/2000 McConnell ..... 415/119
6,126,393 A * 10/2000 Arnold ..... 415/119
6,361,590 B1 * 3/2002 Gilbert et al. ..... 96/384

* cited by examiner

*Primary Examiner*—Fred L Braun
(74) *Attorney, Agent, or Firm*—Tallam I. Nguti

(57) ABSTRACT

An office machine including a machine frame defining an operating environment, operating components mounted within the frame and requiring environmental conditioning such as cooling and cleaning, and an air blower for conditioning the operating environment within the frame. The air blower includes a housing having a housing wall defining an air path and an air discharge opening, a discharge nozzle, mounted over the discharge opening for directing air being discharged away from the housing, a pinch point formed between the housing wall and the discharge nozzle at the discharge opening, an air moving assembly including a rotatable impeller mounted within the housing for drawing air into the air path, and a blower noise reducing device on the pinch point for minimizing air stagnation at the pinch point. The blower noise reducing device includes a first surface for protruding into the air path, and a second surface for protruding into the discharge nozzle, for minimizing air stagnation within the air path and within the discharge nozzle, thereby reducing bower noise.

20 Claims, 7 Drawing Sheets

| 1/3 OCTIVE BANDS | VIRON | MOD 1 | MOD 4 | MARKED 11 | REPEAT 1 TIME | (DELTA) |
|---|---|---|---|---|---|---|
| 160 | 63 db | 63 | 63 | 64 | 63 | 0 |
| 200 | 73.4 | 72.1 | 71 | 71 | 69 | -4.4 |
| 250 | 73.1 | 72 | 71 | 69 | 69 | -4.1 |
| 315 | 82.2 | 79 | 78 | 77 | 77 | -5.2 |
| 400 | 78.2 | 75 | 74 | 74 | 73 | -5.2 |
| 500 | 78.1 | 76 | 74.1 | 74 | 71 | -7.1 |

FIG. 9

OFFICE MACHINE INCLUDING A BLOWER HAVING A BLOWER NOISE REDUCING DEVICE

RELATED APPLICATION

This application is related to U.S. application Ser. No. 09/933,232, entitled "Blower Noise Reducing Device And A Blower Having Same" filed on the same date herewith, and having at least one common inventor.

BACKGROUND OF THE INVENTION

The present invention relates generally to office machines, including electrostatographic reproduction machines, that have blowers, and more particularly, concerns such a machine having a blower noise reducing device.

Office machines such as computers, other data storage and processing devices, and image reproduction machines like copiers, faxes, and printers, typically include a machine frame, operating components within the frame, and a blower for either removing heat or dust particles and dirt from the machine. For example, in a typical toner image reproduction machine, for example an electrostatographic printing process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material, container toner particles, into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrostatographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color.

Dust and the toner particles used in such machines for image development usually are in the form of a fine black powder which tends to escape and deposit on various components of the machine, with deleterious effect. In addition, such machines also include heat generating components such as a fuser apparatus. In general most office machines such as computers and the like include heat generating components or components that tend to heat up, and thus requiring cooling. Typically, the solution to both dust and heat problems is to include an air blower with the machine.

Such air blowers conventionally have noise generating components such as rotating impellers or defusers which having complementary surfaces and configurations within a housing chamber. There is, therefore, a need for office machines that include noise reducing devices within such air blowers.

SUMMARY OF THE INVENTION

In accordance with one aspect of the present invention, there is provided an office machine including a machine frame defining an operating environment, operating components mounted within the frame and requiring environmental conditioning such as cooling and cleaning, and an air blower for conditioning the operating environment within the frame. The air blower includes a housing having a housing wall defining an air path and an air discharge opening, a discharge nozzle, mounted over the discharge opening for directing air being discharged away from the housing, a pinch point formed between the housing wall and the discharge nozzle at the discharge opening, an air moving assembly including a rotatable impeller mounted within the housing for drawing air into the air path, and a blower noise reducing device on the pinch point for minimizing air stagnation at the pinch point. The blower noise reducing device includes a first surface for protruding into the air path, and a second surface for protruding into the discharge nozzle, for minimizing air stagnation within the air path and within the discharge nozzle, thereby reducing bower noise.

BRIEF DESCRIPTION OF THE DRAWINGS

The foregoing and other features of the instant invention will be apparent and easily understood from a further reading of the specification, claims and by reference to the accompanying drawings in which:

FIG. 9 is a table of noise level measurements from a typical blower without (column 2), and with various models of the noise reducing device of the present invention.

DETAILED DESCRIPTION OF THE INVENTION

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

Figure 1:
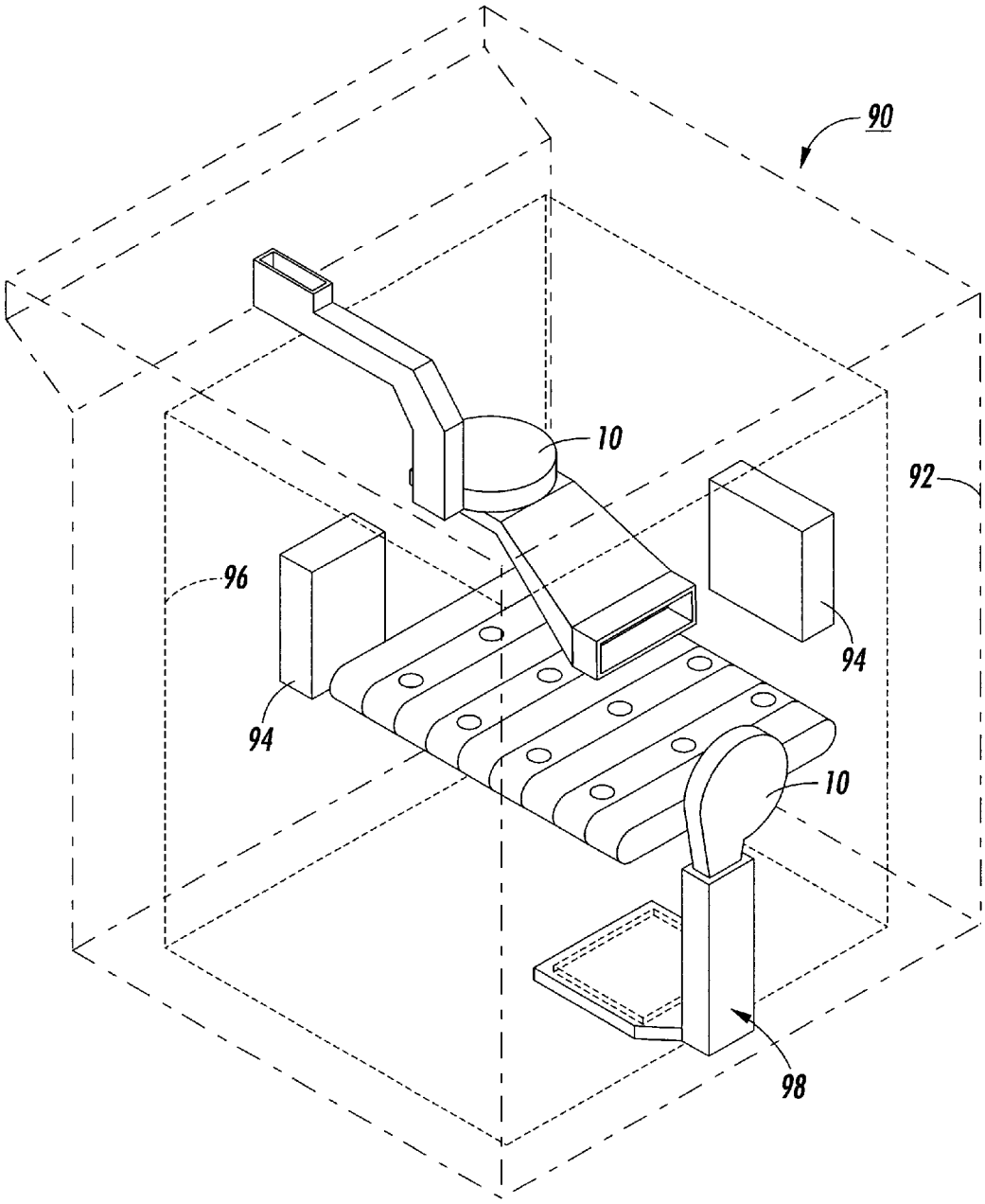
FIG. 1 is a perspective illustration of a generic office machine including an air blower having the noise reducing device of the present invention.

Referring now to FIG. 1, an office machine 90, such as a computer, other data storage and/or processing device, or an image reproduction machine like a copier, or printer, or the like, is illustrated. As illustrated, such an office machine includes a machine frame 92, operating components 94 within an operating environment 96 inside the frame 92, and a cooling or a noise, ozone and dirt (NOHAD) system 98 including at least one air blower or air blower assembly 10 in accordance with the present invention (to be described in detail below). The system 98 is suitable for either removing heat or dirt and dust particles from within the operating environment 96 of the machine 90. This is usually because the operating environment requires environmental conditioning such as cooling and/or cleaning.

Figure 2:
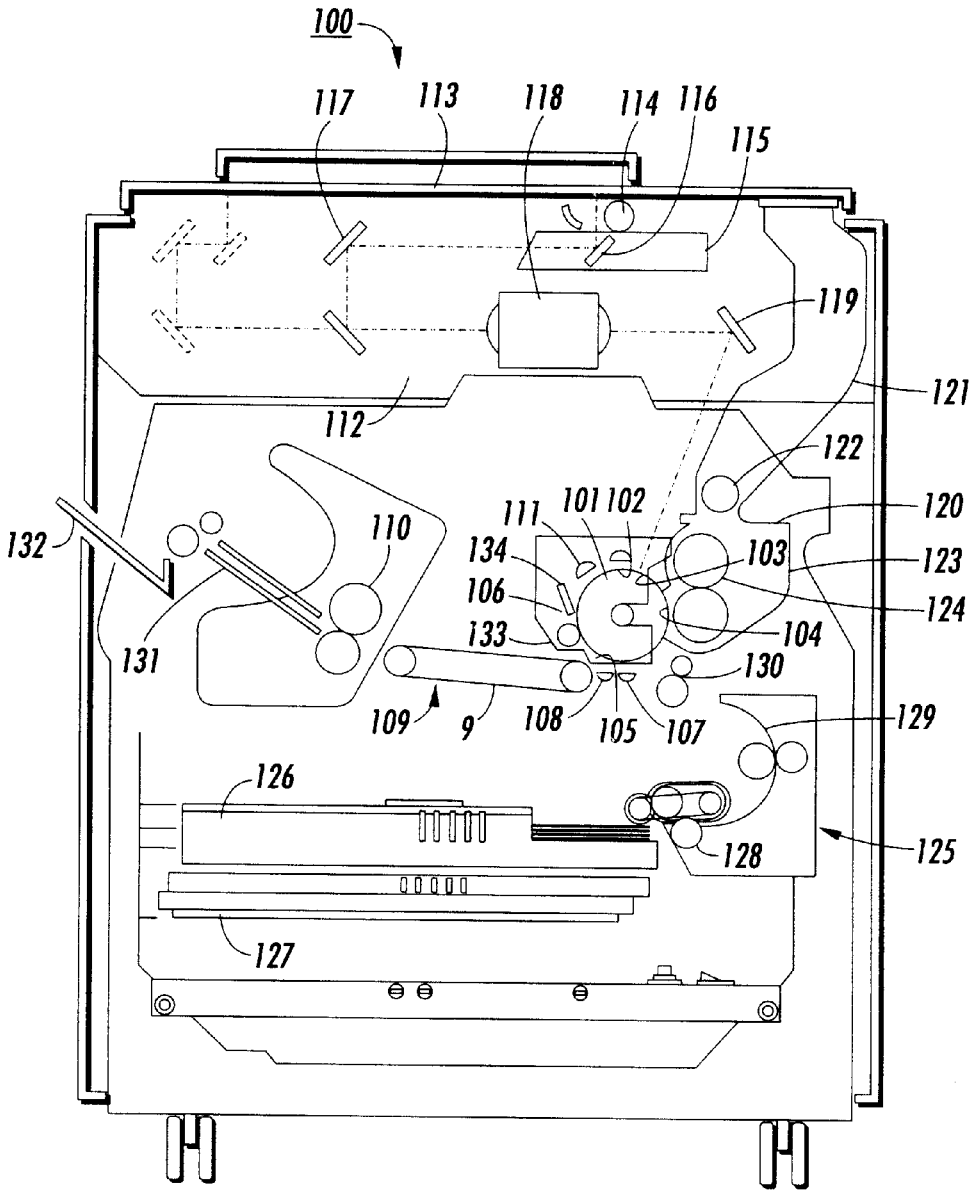
FIG. 2 is a vertical sectional illustration of a toner image reproduction office machine including an air blower having the noise reducing device of the present invention.

Referring now to FIG. 2, there is shown a particular office machine, for example a xerographic copying office machine 100 incorporating the present invention. The xerographic copying office machine 100 as shown includes a photoreceptor drum 101 mounted for rotation (in the clockwise direction as seen in FIG. 1) to carry the photoconductive imaging surface of the drum sequentially through a series of xerographic processing stations; a charging station 102, an imaging station 103, a development station 104, a transfer station 105, and a cleaning station 106. The charging station 102 comprises a corotron which deposits a uniform electrostatic charge on the photoreceptor. A document to be reproduced is positioned on a platen 113 and scanned by means of a moving optical scanning system to produce a flowing light image on the drum at 103. The optical image selectively discharges the photoconductor in image configuration, whereby an electrostatic latent image of the object is laid down on the drum surface.

At the development station 104, the electrostatic latent image is developed into visible form by bringing into contact with it toner particles which deposit on the charged areas of the photoreceptor. Cut sheets of paper are moved into the transfer station 105 in synchronous relation with the image on the drum surface and the developed image is transferred to a copy sheet at the transfer station 105, where a transfer corotron 107 provides an electric field to assist in the transfer of the toner particles thereto. The copy sheet is then stripped from the drum 101, the detachment being assisted by the electric field provided by an AC de-tack corotron 108. The copy sheet carrying the developed image is then carried by a transport belt system 109 to a fusing station 110. After transfer of the developed image from the drum, some toner particles usually remain on the drum, and these are removed at the cleaning station 106.

After cleaning, any electrostatic charges remaining on the drum are removed by an AC erase corotron 111. The photoreceptor is then ready to be charged again by the charging corotron 102, as the first step in the next copy cycle. The optical image at imaging station 103 is formed by optical system 112. A document (not shown) to be copied is placed on platen 113, and is illuminated by a lamp 114 that is mounted on a scanning carriage which also carries a mirror 116. Mirror 116 is the full-rate scanning mirror of a full and half-rate scanning system. The full-rate mirror 116 reflects an image of a strip of the document to be copied onto the half-rate scanning mirrors 117. The image is focused by a lens 118 onto the drum 101, being deflected by a fixed mirror 119. In operation, the full-rate mirror 116 and lamp 114 are moved across the machine at a constant speed, while at the same time the half-rate mirrors 117 are moved in the same direction at half that speed. At the end of a scan, the mirrors are in the position shown in a broken outline at the left hand side of FIG. 1.

These movements of the mirrors maintain a constant optical path length, so as to maintain the image on the drum in sharp focus throughout the scan. At the development station 104, a magnetic brush developer system 120 develops the electrostatic latent image. Toner is dispensed from a hopper 121 by means of a rotating foam roll dispenser 122, into developer housing 123. Housing 123 contains a two-component developer mixture comprising a magnetically attractable carrier and the toner, which is brought into developing engagement with drum 101 by a two-roller magnetic brush developing arrangement 124. The developed image is transferred at transfer station 105, from the drum to a sheet of copy paper (not shown) which is delivered into contact with the drum by means of a paper supply system 125. Paper copy sheets are stored in two paper trays, an upper, main tray 126 and a lower, auxiliary tray 127. The top sheet of paper in either one of the trays is brought, as required, into feeding engagement with a common, fixed position, sheet separator/feeder 128. Sheet feeder 128 feeds sheets around curved guide 129 for registration at a registration point 130. Once registered, the sheet is fed into contact with the drum in synchronous relation to the image so as to receive the image at transfer station 105.

The copy sheet carrying the transferred image is transported by means of vacuum transport belt 9, to fuser 110, which is a heated roll fuser. The image is fixed to the copy sheet by the heat and pressure in the nip between the two rolls of the fuser. The final copy is fed by the fuser rolls along output guides 131 into catch tray 132, which is suitably an offsetting catch tray, via output nip rolls. After transfer of the developed image from the drum to the copy sheet, the drum surface is cleaned at cleaning station 106. At the cleaning station, a housing 133 forms with the drum 101 an enclosed cavity, within which is mounted a doctor blade 134. Doctor blade 134 scrapes residual toner particles off the drum, and the scraped-off particles then fall into the bottom of the housing, from where they are removed by an auger.

Referring now to FIGS. 3–6 and 8, the air blower in accordance with the present invention, is shown generally and in detail as 10. As illustrated, the blower 10 includes a housing 12 having walls 13, 14 defining an intake region 47, an internal air path or volute 24 through which air moves, and a discharge region 48 including a discharge opening 25. The blower 10 also includes an air moving assembly in the form of a bladed impeller assembly 16, which rotates around a laterally extending axis 18 to draw air axially inwardly, as indicated by the arrow 20, through a grill 22 within the intake region 47. The impeller assembly 16 then directs the incoming air radially and outwardly into the volute 24. Within the volute 24, the air is centrifugally accelerated by the impeller assembly blades 36, towards the discharge region 48, and ultimately communicated to and through the discharge opening 25 into a discharge conduit 26. The impeller assembly 16 for example is driven rotatably by power that in the case of an office machine can be, and usually is, coupled from the main power supply of the office machine itself.

Figure 5:
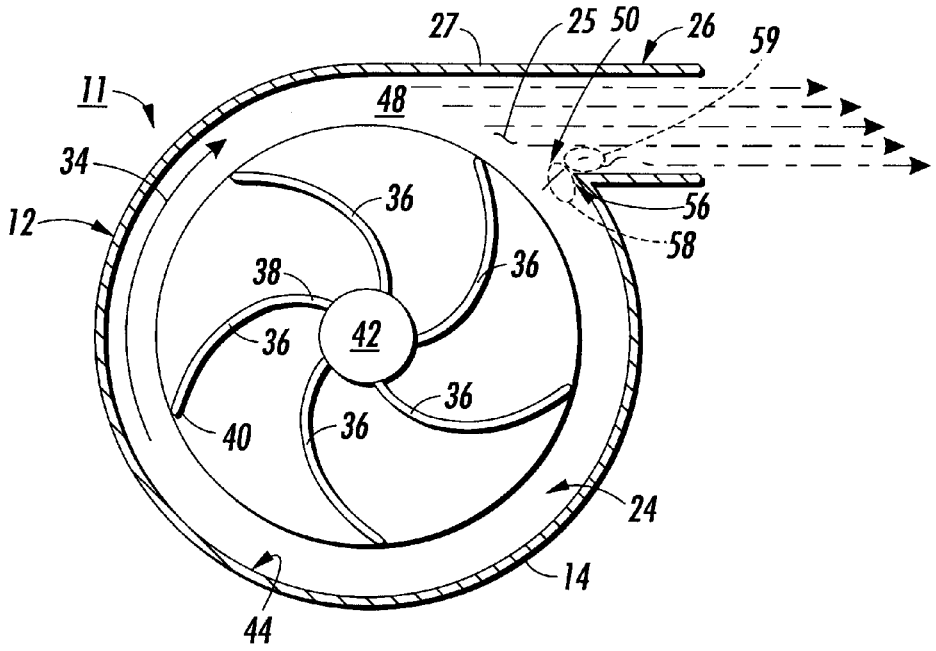
FIG. 5 (PRIOR ART)
FIG. 5 is a schematic of a conventional blower without the noise reducing device of the present invention.

FIG. 5 illustrates a conventional similar blower 11 that likely suffers from the noise problems being addressed by the present invention because it does not include the noise reducing device of the present invention. The precise air flow pattern into and through the blower housing 12 can be seen for example in FIGS. 5 (prior art) and 6. In each case, the motor 28 drives the impeller assembly 16 in the direction of the arrow 34. The impeller assembly 16 has radially projecting blades 36 which are spaced uniformly around the axis 18 of the impeller assembly 16. Relative to air movement, each blade has an upstream end 38 and a radially outwardly spaced downstream end 40. Between the axis 18 and the upstream ends 38 of the blades 36, a core volume 42 exists that does not have any air accelerating blades therewithin.

The blades 36 when being rotated, centrifugally propel air against a radially and inwardly facing surface 44 of the volute 24. As such, a low pressure region is thereby developed in the core volume 42, as a result of which intake air is drawn axially and laterally through the air intake grill 22 and into the core volume 42. Initially, the air flows axially, then the impeller assembly 16 abruptly changes its direction is so that it then flows in the radial direction as described above. The radial flow again abruptly changes direction upon encountering the radially and inwardly facing surface 44 of volute 24, after which such air then moves in a curved path, through the volute 24, in the direction of the arrow 34.

The volute 24 may be designed such that it progressively increases in volume from the intake region 47 towards the discharge region 48. As illustrated, within the volute 24, the air is moved from the intake region 47, and is accelerated and expanded, in the progressively increasing volume of the volute 24, until some of it, after branching at a juncture or pinch point 50, is discharged through the discharge opening 25 into the discharge conduit 26. The rest of it, after branching at a juncture or pinch point 50, continues to move through the volute 24.

Typically, a blower 10, 11 has a number of areas at which noise generation is significant when moving air as above through the volute 24. For example, as shown in FIG. 5 (prior art), an area of significant noise generation is located at the branching juncture or pinch point 50 where the air accelerated by the impeller assembly 16 branches so that some of it is discharged through the discharge opening 25 and into the discharge conduit 26, and the rest re-enters the volute 24 at the intake region 47.

Figure 3:
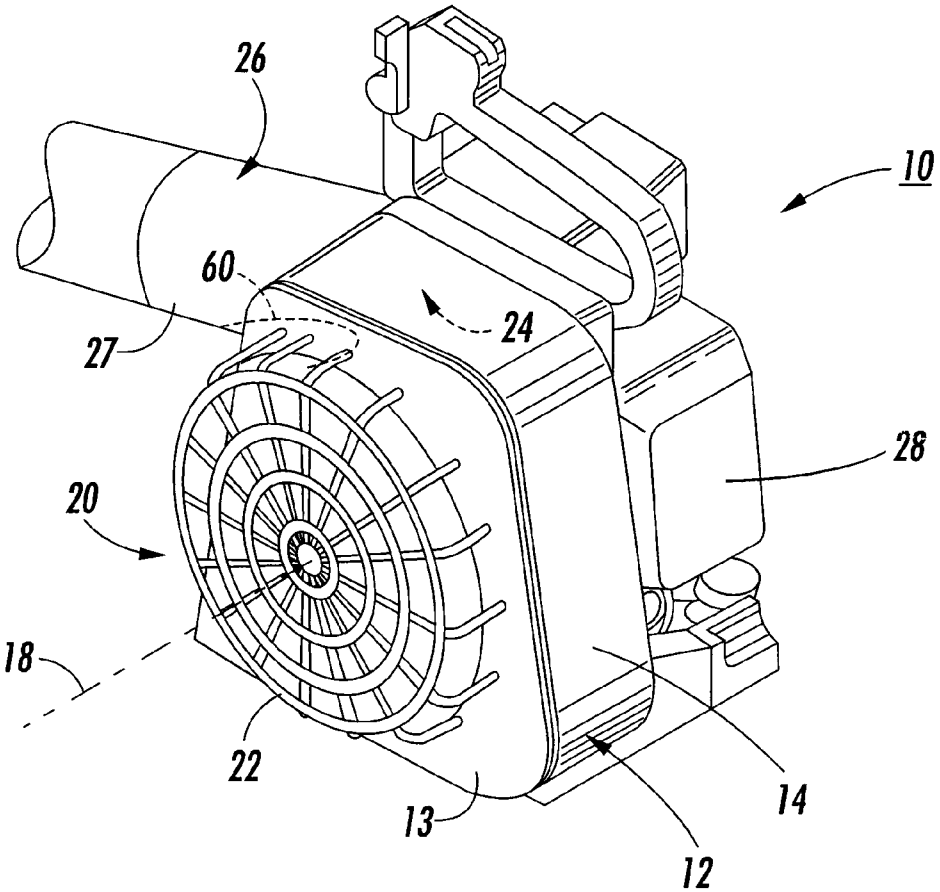
FIG. 3 is a fragmentary, perspective view of an exemplary blower of the present invention including a noise reducing device in accordance with the present invention.

As illustrated, the juncture or pinch point 50 is located at an intersection of a first generally flat surface 52 of the walls 13, 14 of blower housing 12, and a second generally flat surface 54 of the wall 27 of the discharge conduit 26. Because the discharge nozzle 26 is arranged for tangential flow of accelerated air out of the volute 24, the juncture or pinch point 50 as shown in FIG. 3 is ordinarily at a V-shaped apex 56 defined by the flat surface 52 of the blower housing 12 and that 54 of the nozzle wall 27, meeting and being connected in an impervious manner.

It has been found that at the juncture or pinch point 50 between the surfaces 52, 54 there is ordinarily a stagnation point 58 within the volute 24, and a stagnation point 59 within the discharge nozzle 26 (FIG. 5), where some of the air being accelerated and branched between the continued volute 24 and the discharge conduit 26, abruptly stops and is stagnated. Such stagnated air within the volute 24 is then sheared by the radially outwardly spaced downstream end 40 of each of the rotating blades 36 as it is rotated past the juncture or pinch point 50. The shearing has been found to cause and produce a significant amount of noise, for example, see TABLE 1 and FIG. 9, column 2 in each case.

Figure 4:
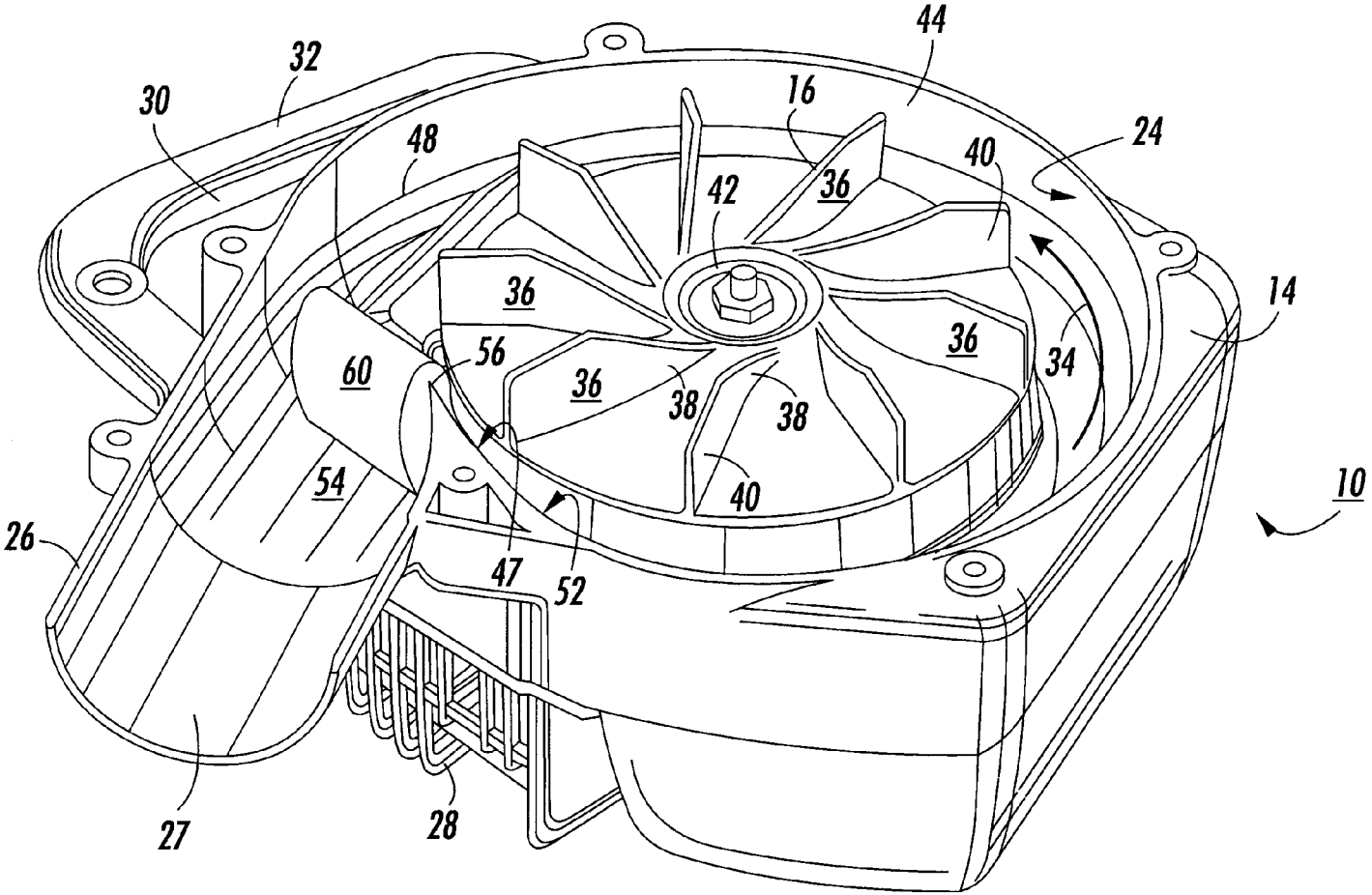
FIG. 4 is an enlarged, perspective view of the blower in FIG. 1 with part of the housing thereon removed to show the noise reducing device of the present invention.
Figure 6:
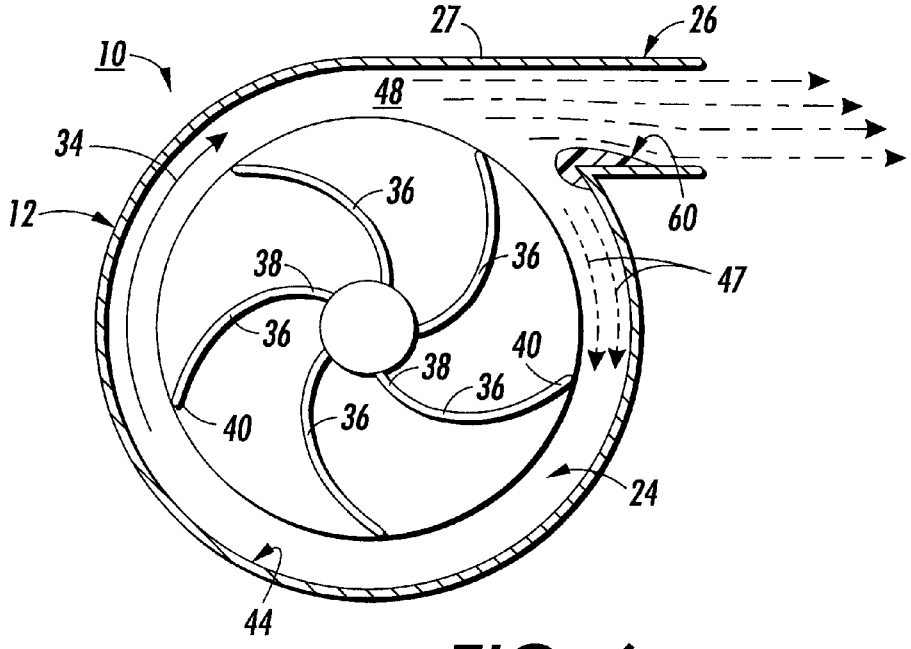
FIG. 6 is a schematic of the blower of the present invention including the noise reducing device of the present invention.

Referring now to FIGS. 4–6, it has been found that the shearing noise caused at the juncture or pinch point between the flat surface of a volute and a flat surface of a discharge conduit in a blower (for example juncture or pinch point 50) can be significantly reduced by a blower noise reducing device 60. As shown, the blower noise reducing device 60 can be formed as a part of the housing 12 or discharge conduit 26. It can also be an insert that is attached to either or both the housing 12 or conduit 26, and over what would ordinarily be the apex 56 at the juncture or pinch point, for example juncture or pinch point 50. As further illustrated, the noise reducing device 60 comprises a moving air deflecting member 62 that has a generally triangular cross-section 64, a first end 66 representing a base 67 of the generally triangular cross-section, a second end 68 representing an apex portion 70 of the generally triangular cross-section 64, a first side 72 for mounting against a wall of the discharge nozzle 26 (at the connecting point and hence at the juncture or pinch point 50 between the discharge opening 25 and the discharge nozzle 26) and a second and opposite side 74. The second and opposite side 74 as shown is shaped for protruding into the discharge opening 25 and into the discharge nozzle 26 when the first side 72 is formed or mounted against the wall 27 of the discharge nozzle 26. It has been found that the noise reducing device 60 as shaped, and when formed or mounted as described, significantly alters the noise causing characteristics (for example stagnation) of some of the air being moved within the volute 24, as well as within the discharge nozzle 26. The noise reducing device 60 does so by aerodynamically deflecting such moving air in a predetermined manner as shown in FIG. 6.

As further shown, the moving air deflecting member 62 includes a heel-like or heel portion 76 located at the first end 66 for projecting into the volute 24, particularly into the intake region 47 of the volute for modifying the inside profile of the volute, and hence the flow pattern of the air being moved, at the discharge opening 25, in other words at the intake region 47. The heel portion 76 has a first surface 77 aligned with the base 67 of the triangular cross-section 64, and a second surface 78 for attaching to, or that is connected to, the inside of the walls 13, 14 of the volute 24. The second surface 78 of the heel portion 76 comprise the part thereof projecting into the volute 24. The projection of the heel portion 76 into the volute 24 of course is such as not to interfere with free movement or rotation of the distal ends 40 of the rotating blades 36 of the blower impeller assembly 16. The projection or protrusion of the second surface 78 of the heel portion 76 into the volute 24 changes or alters the profile of the blower volute tongue or intake region 47. The projection or protrusion of the second side 74 into the discharge nozzle 26 also changes or alters the profile of the discharge nozzle 26 near the juncture 50.

Figure 7:
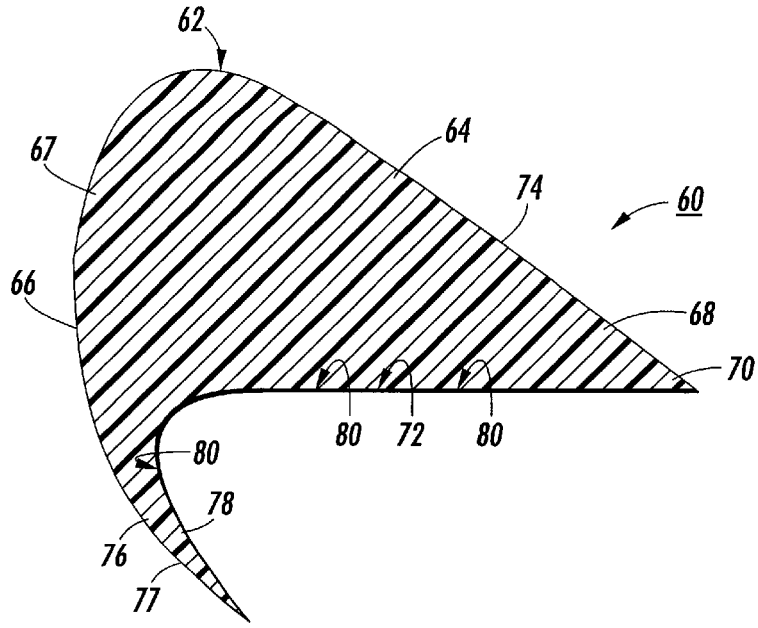
FIGS. 7 and 8 are detailed illustrations of the noise reducing device of the present invention.
Figure 8:
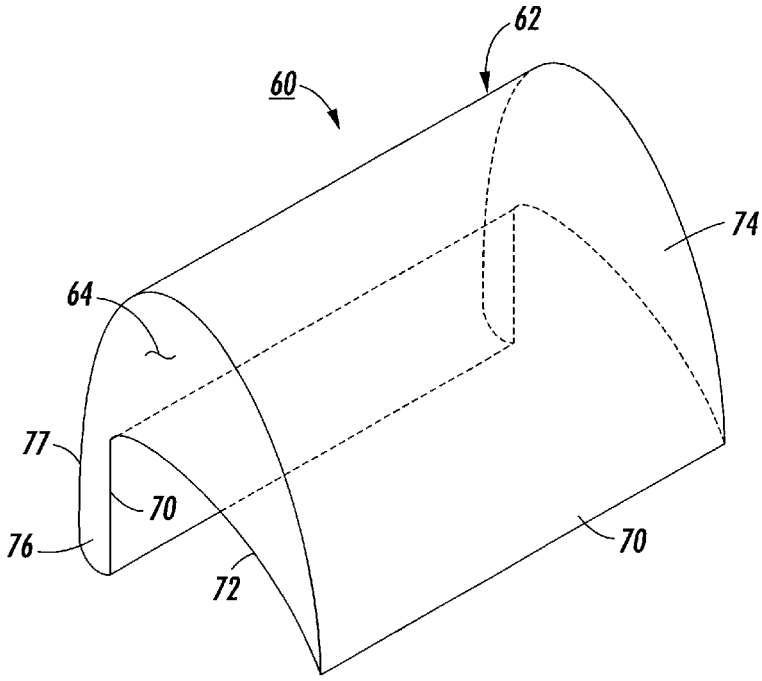

These changes or alterations have been found to minimize air stagnation, and hence air shear at or near the juncture 50. The result is a significant reduction in the overall noise level, as well as in the blade passage noise level. As shown in FIG. 7, in one experiment, such noise for example was reduced significantly from 78.1 dB to 71 dB in the 500 Octive bandwidth.

In the case where the air deflecting member 62 or noise reducing device 60 is an insert, the heel portion 76 may include provisions or features 80 for allowing or enabling it to be attached to the walls 13, 14 and 27 of the volute 24 and nozzle 26, respectively.

As mounted, that portion of the noise reducing device 60 or the moving air deflecting member 62 that lies within the discharge nozzle 26, comprises a reverse-airfoil in shape, relative to air being discharged by the blower through the nozzle 26. As a consequence, the discharge nozzle 26 becomes more aerodynamic and efficient and thus also contributing to the reduction in overall noise level.

When the noise reducing device 60 is an insert, it need not be made of the same material as the walls 13, 14 of the blower housing. In fact, it can be made of a suitable non-metallic material such as rubber, plastic, or wood, or out of a suitable metallic material, provide any such material is an air impervious material so as to suitably deflect moving air. The insert as such can then be installed or retrofitted into even off-the-shelf blowers for reducing blower noise, and without affecting performance of the blower. Where the attaching or mounting provision is for example an adhesive, or merely a friction fitting slot over the V-shaped apex 56 of the blower housing, the insert or moving air deflecting member 62 can therefore be easily added or retro-fitted to an existing standard blower with no tooling costs to the blower supplier.

Without the present invention, the typical conventional approach for noise reducing blower noise would be to add a muffler system which is more costly and would complicate the overall air system. The benefits from use of the noise reducing device 60 of the present invention therefore include the reduced noise level itself, and the avoidance or replacement of such muffler systems.

Table 1, and FIG. 9 illustrate the effectiveness of the present invention by showing experimental measurements of blower noise at various Octive Bands (column 1) for a typical blower without the present invention (column 2), and for reductions due to use of trial models of the device of the present invention to modify the tongue/pinch point of the particular blower.

In this experiment, the blade passage frequently is the number of times that an actual blade passes by the pinch point. As an equation:

Blade Passage Frequency=(# of blades) (Rev/Min) (Min/60 Sec)= (6) (2850 R/Min) (Min/60 Sec)=285 Pulse/Sec.

A look at the 1/3 Octive data clearly shows that the pure tone falls in the 312 octive band which is relatively close to the 285 Pulse/Sec calculation. This therefore shows that the blade passage frequency is the source of the noise.

TABLE 1

| 1/3 Octive Bands | Blower Without invention | Blower With Mod. 1 | Blower With Mod. 4 | Blower With Mod. 11 | Blower With Mod. 12 | Reduction dB |
|---|---|---|---|---|---|---|
| 160 | 63 dB | 63 | 63 | 64 | 63 | 0 |
| 200 | 73.4 | 72.1 | 71 | 71 | 69 | −4.4 |
| 250 | 73.1 | 72 | 71 | 69 | 69 | −4.1 |
| 315 | 82.2 | 79 | 78 | 77 | 77 | −5.2 |
| 400 | 78.2 | 75 | 74 | 74 | 73 | −5.2 |
| 500 | 78.1 | 76 | 74.1 | 74 | 71 | −7.1 |

As can be seen, there has been provided an office machine including a machine frame defining an operating environment, operating components mounted within the frame and requiring environmental conditioning such as cooling and cleaning, and an air blower for conditioning the operating environment within the frame. The air blower includes a housing having a housing wall defining an air path and an air discharge opening, a discharge nozzle, mounted over the discharge opening for directing air being discharged away from the housing, a pinch point formed between the housing wall and the discharge nozzle at the discharge opening, an air moving assembly including a rotatable impeller mounted within the housing for drawing air into the air path, and a blower noise reducing device on the pinch point for minimizing air stagnation at the pinch point. The blower noise reducing device includes a first surface for protruding into the air path, and a second surface for protruding into the discharge nozzle, for minimizing air stagnation within the air path and within the discharge nozzle, thereby reducing bower noise.

While the invention has been described with reference to the structure herein disclosed, it is not confined to the details as set forth and is intended to cover any modification and changes that may come within the scope of the following claims.

What is claimed is:

1. An office machine comprising:

(a) a machine frame defining an operating environment;

(b) operating components mounted within said frame and requiring environmental conditioning such as cooling and cleaning; and (c) an air blower for conditioning the operating environment within said frame, said air blower including:

(i) a housing having a housing wall defining an air path, and an air discharge opening;

(ii) a discharge nozzle, mounted over said discharge opening for directing air being discharged away from said housing;

(iii) a pinch point formed between said housing wall and said discharge nozzle at said discharge opening;

(iv) an air moving assembly including a rotatable impeller mounted within said housing for drawing air into said air path; and (v) a blower noise reducing device on said pinch point for minimizing air stagnation at said pinch point, said blower noise reducing device including a first surface for protruding into said air path, and a second surface for protruding into said discharge nozzle for minimizing air stagnation within said air path and within said discharge nozzle.

2. An office machine comprising:

(a) a machine frame defining an operating environment;

(b) operating components mounted within said frame and requiring environmental conditioning such as cooling and cleaning; and (c) air blower for conditioning said operating environment, said air blower including:

(i) a housing having walls defining an intake region for incoming air, a discharge region including a discharge opening for discharging air from said housing, and an air path for controllably directing air entering said intake region towards said discharge region;

(ii) an air moving assembly including a rotatable impeller mounted within said housing for drawing air into said air path through said intake region, and for accelerating air within said air path towards said discharge region;

(iii) a discharge nozzle, mounted over said discharge opening, for directing air being discharged away from said housing; and (iv) a blower noise reducing device comprising a moving air deflecting member having:

(a) a generally triangular cross-section;

(b) a first end representing a base of said generally triangular cross-section;

(c) a second end representing an apex of said generally triangular cross-section;

(d) a first side for mounting against a wall of the discharge nozzle (at a connecting point between the discharge opening and the discharge nozzle); and (e) a second and opposite side, said second and opposite protruding into the discharge opening and discharge nozzle when said first side is mounted against the wall of the discharge nozzle for reducing noise causing characteristics of air being moved by the blower by deflecting such moving air in a predetermined manner.

3. The office machine claim 2, wherein said moving air deflecting member includes a heel portion at said first end.

4. The office machine claim 3, wherein said heel portion has a first surface aligned with said base of said triangular cross-section.

5. The office machine claim 3, wherein said heel portion has a second surface for attaching to a wall of a volute.

6. The office machine claim 2, wherein said moving air deflecting member is made of a non-metallic material.

7. The office machine claim 2, wherein said moving air deflecting member is made of a metallic material.

8. The office machine claim 2, wherein said discharge nozzle is attached tangentially to said blower housing.

9. The office machine claim 2, wherein said air moving assembly includes drive means for rotating an impeller assembly.

10. The office machine claim 2, wherein a volume of said air path increases from said intake region to said discharge region.

11. The office machine claim 2 wherein said first end representing said base of said generally triangular cross-section has an external surface for projecting into the volute.

12. The office machine claim 2, wherein as mounted within the discharge nozzle, said moving air deflecting member comprises a reverse-airfoil relative to air being discharged through the discharge nozzle.

13. An electrostatographic reproduction machine comprising:

(a) an image bearing member having an imaging surface for carrying a toner image;

(b) a copy sheet supply and handling assembly for moving a copy sheet into a toner image transfer relationship with said image bearing member;

(c) imaging devices for forming a toner image on said imaging surface of said image bearing member and transferring the toner image to a copy sheet; and (d) an air blower including:

(i) a housing having a housing wall defining an air path, and an air discharge opening;

(ii) a discharge nozzle, mounted over said discharge opening for directing air being discharged away from said housing;

(iii) a pinch point formed between said housing wall and said discharge nozzle at said discharge opening;

(iv) an air moving assembly including a rotatable impeller mounted within said housing for drawing air into said air path; and (v) a blower noise reducing device on said pinch point for minimizing air stagnation at said pinch point, said blower noise reducing device including a first surface for protruding into said air path, and a second surface for protruding into said discharge nozzle for minimizing air stagnation within said air path and within said discharge nozzle.

14. The office machine claim 13, wherein said first end representing said base of a generally triangular cross-section has an external surface for projecting into the volute.

15. The office machine claim 13, wherein as mounted within the discharge nozzle, said moving air deflecting member comprises a reverse-airfoil relative to air being discharged through the discharge nozzle.

16. The office machine claim 13, wherein said moving air deflecting member is made of a non-metallic material.

17. The office machine claim 13, wherein said moving air deflecting member is made of a metallic material.

18. The office machine claim 13, wherein said discharge nozzle is attached tangentially to said blower housing.

19. The office machine claim 13, wherein said air moving assembly includes drive means for rotating said impeller assembly.

20. The office machine claim 13, wherein a volume of said air path increases from an intake region to said discharge region.

* * * * *